United States Patent [19]

Yamazaki

[11] Patent Number: 4,822,242

[45] Date of Patent: Apr. 18, 1989

[54] VARIABLE CAPACITY TURBO SUPERCHARGER

[76] Inventor: Yoichi Yamazaki, No. 6-7, Akehara 3-chome, Kashiwa-shi, Chiba-ken, Japan

[21] Appl. No.: 201,750

[22] Filed: Jun. 3, 1988

[30] Foreign Application Priority Data

Jun. 9, 1987 [JP] Japan ..... 61-142203

[51] Int. Cl.[4] ..... F01D 1/08

[52] U.S. Cl. ..... 415/205

[58] Field of Search ..... 415/182, 183, 184, 203, 415/204, 205, 219 A, 219 B

[56] References Cited

U.S. PATENT DOCUMENTS

| | | | |
|---|---|---|---|
| 2,981,516 | 4/1961 | Egli | 415/205 X |
| 3,380,711 | 4/1968 | Blattner et al. | 415/205 X |
| 3,734,650 | 5/1973 | Reisacher et al. | 415/205 X |
| 4,512,716 | 4/1985 | Marr et al. | 415/205 |

FOREIGN PATENT DOCUMENTS

| | | | |
|---|---|---|---|
| 86467 | 8/1983 | European Pat. Off. | 415/205 |
| 190726 | 12/1966 | U.S.S.R. | 415/205 |
| 2002853 | 2/1979 | United Kingdom | 415/205 |

*Primary Examiner*—Robert E. Garrett
*Assistant Examiner*—Joseph M. Pitko
*Attorney, Agent, or Firm*—Griffin, Branigan & Butler

[57] ABSTRACT

A variable capacity turbo supercharger is disclosed, in which a nozzle of a turbine is a vaneless nozzle, a scroll chamber having a flow path having a circular or like sectional profile which can keep a swirling state is disposed sidewise of the nozzle, an exhaust gas inlet passage for introducing engine exhaust gas into the scroll chamber is provided with fixed swirling generation means for imparting to the exhaust gas passing through the scroll chamber a swirling whose rotational direction is such that the rotation of the gas moves away from the turbine rotor in the neighborhood of the outlet of the scroll chamber into the nozzle, and a pitch of the swirling is flexible in the direction of the flow path according to the change of the amount of the gas generated from the engine and the rotation velocity of turbine rotor so that the outside compression efficiency for the gas flow in the nozzle is variable as if the capacity of the turbine changed by itself.

2 Claims, 6 Drawing Sheets

VARIABLE CAPACITY TURBO SUPERCHARGER

BACKGROUND OF THE INVENTION

This invention relates to a variable capacity turbo supercharger, which utilizes for the variable capacity the character of the engine exhaust gas as gaseous fluid without using any movable part at all.

A turbo supercharger which is adopted as automotive supercharger engine is required to have a broad working range and also satisfactory supercharge pressure response at the time of sudden acceleration.

To meet the above demands, there has been a well-known variable capacity turbo supercharger with variable static vanes provided in a turbine nozzle. This turbo supercharger, however, has not yet been adopted for general passenger cars because of the facts that it greatly increases the number of components made of heat-resistant alloys which are expensive and difficulty capable of cutting, that it requires high accuracies of finishing and assembling, and that it requires a complicated link mechanism for harmonious operation of a plurality of static vanes, these requirements leading to a great cost increase.

As the variable turbo supercharger the above variable static vane type is ideal. Up to date, there has been realized two simplified variable capacity turbo superchargers.

One of these variable capacity turbo superchargers has a movable flap which is provided in lieu of turbine scroll tongues. The flap is formed at one end with a throat and are rotated about the opposite end to vary the area of the throat so as to attain variable capacity.

The other variable capacity turbo supercharger has a turbine scroll chamber which is dividable in the axial direction into two halves. An on-off valve is provided on an exhaust gas supply passage leading to one of the two scroll chamber halves and is adapted to change the throat area in two stages, thereby attaining the variable capacity.

In comparison to the aforesaid variable vane type, the variable flap type consists of a single flap. The scroll type axially dividable into two halves uses a simple on-off valve. In these types, therefore, the cost increase can be reduced. However, these types also require an actuator for driving the variable part and also a control unit for controlling the operation of the actuator. For this reason, a great cost increase compared to the conventional fixed capacity type is inevitable. Therefore, even if the simplified types noted above are adopted for ceramic turbo superchargers and twin turbos, further cost increase is inevitable, and the adaptation of these simplified types is impractical.

The supercharge pressure response is the most important performance of the current automotive turbo supercharger. In a variable capacity turbo supercharger in which the turbine throat area is varied as noted above, when suddenly accelerating the engine from the idling or the like operating condition in which the turbine rotor is rotated at a very low speed, the supercharge pressure response can be improved by temporarily extremely reducing the throat area and then continuously increasing the throat area. To this end, however, high response and displacement accuracy are required for the variable part drive unit, the control system is complicated, and the reliability is reduced.

At present, however, no continuous control corresponding to the situation of a sudden acceleration or like other than the constant situation has been realized. The most ideal variable static vane is not adopted for passenger cars, in which the acceleration property is imporant. This is so because even if the expensive variable vane type is adopted, the continuous control as noted above can not be realized.

Further, in the axially dividable scroll type as noted above, even if the on-off valve opening is continuously controlled in the manner as noted before, the throat area of the scroll chamber half without the on-off valve can not be extremely minimized out of the consideration for the entire engine-operating condition ranges. Besides, the scroll chamber half with the on-off valve can serve only as a bypass passage for controlling the gas velocity in the other scroll chamber half. Therefore, the gas having passed through this scroll chamber half does not provide an effective action.

Moreover, it generates undesirable vortex between adjacent turbine rotor vanes due to the speed difference between the gas from one scroll chamber half and the gas from the other scroll chamber half. For the above reasons, this type has no particular advantage.

Usually, therefore, in this type the on-off valve is switched to either fully open or fully closed state, but the response with respect to the supercharge pressure at the time of a sudden acceleration is no so satisfactory.

SUMMARY OF THE INVENTION

An object of the invention is to provide a variable capacity turbo supercharger, which can adopt itself to the same state as the turbine capacity has been changed in correspondence to the engine-operating condition without use of any movable part and can continuously cope with a sudden acceleration with satisfactory response.

To attain the above object of the invention, there is provided a variable capacity turbo supercharger, in which a nozzle of a turbine is a vaneless nozzle, a scroll chamber having a circular or like sectional profile disposed sidewise of the nozzle, and an exhaust gas inlet passage for introducing engine exhaust gas into the scroll chamber is provided with fixed swirling generation means for imparting to the exhaust gas passing through the scroll chamber a swirling like a screw whose rotational direction is such that the rotation of said gas moves away from said turbine rotor at the neighborhood of the outlet of said scroll chamber into said nozzle.

The operation of such turbo supercharger will be described with reference to FIG. 4 to 6. FIGS. 4 and 5 show the relation between the orbit D of swirling of exhaust gas in a scroll chamber 13 and the orbit E of whirling of the gas in a nozzle 12. FIG. 4 shows the relation in a low-speed engine-operating condition, and FIG. 5 shows a high-speed engine-operating condition. When the engine speed is low, the gas is generated at a comparatively low amount, so that the gas expansion ratio between the upstream and downstream sides of the throat 17 which is an inlet of the scroll chamber is reduced compared to that in the high-speed engine-operating condition. Therefore, as shown in FIG. 4, the swirling pitch in the scroll chamber 13 of the orbit $D_1$ of the swirling generated in a helical passage 16 as fixed swirling generation means is small when the engine speed is low.

Therefore, a ratio of the radial velocity component of the absolute velocity at the neighborhood of the outlet of the scroll chamber 13 into the nozzle 12 to the said absolute velocity (hereinafter referred to as "ratio R") in said low-speed engine-operating condition. Also, the sectional area of the flow path in the scroll chamber 13 is reduced in the direction of the gas flow.

For this reason and also due to the comparatively small swirling pitch as noted above, the stream of gas forced into the nozzle 12 is as shown by a whirling orbit $E_1$ after outside compression in the nozzle 12. The gas stream increases its speed in the circumferential direction of the turbine rotor 15, so that the gas stream is just like a gas stream when the variable static vanes of the variable static vane type are throttled.

Thus, in the low-speed engine-operating condition in which less gas is generated, a high supercharge pressure can be obtained by causing rotation of the turbine rotor 15 at a high speed.

On the other hand, in the high-speed engine-operating condition, the gas is generated at a comparatively high amount. Therefore, the gas expansion ratio between the upstream and downstream sides of the throat 17 is increased compared to that in the low-speed engine-operating condition. The swirling pitch of the swirling orbit $D_2$ of the gas in the scroll chamber 13 is thus widened as shown in FIG. 5, so that ratio R in high-speed engine-operating condition is reduced compared to the ratio R in the low-speed engine-operating condition. Therefore, the gas stream forced into the nozzle 12 is not substantially compressed to the outside, and a whirlng orbit $E_2$ is obtained. That is, the gas stream is just like a gas stream obtained when the variable static vanes are open. Thus, in the high-speed engine-operating condition in which the gas is generated at a high amount, a large amount of gas can be effectively provided for action on the turbine rotor 15 to obtain effective supercharge.

As has been shown, according to the invention the operating range, in which effective supercharge pressure is generated is spread to attain the variable capacity.

FIG. 6 shows a velocity triangle representing the gas flow. When the absolute velocity of the gas is $C_1$, denoting the peripheral speed of the turbine rotor 15 by "$U_1a$" when the rotational speed of the turbine rotor is low and "$U_1b$" when the engine speed is high, the directions of the gas velocity relative to the turbine rotor 15 is respectively "$W_1a$" and "$W_1b$", and the geometrical inlet area between adjacent vanes of the turbine rotor 15 with respect to the directions "$W_1a$" and "$W_1b$" are respectively "a" and "b". The area "a" is smaller than the area "b", and this means that in the low-speed rotation of the turbine rotor 15 the gas is throttled by the turbine rotor 15. Therefore, when the engine is suddenly accelerated from the idling speed, in which the rotational speed of the turbine rotor 15 is lowest, the gas is temporarily throttled to the utmost extent by the turbine rotor 15. Therefore, the swirling pitch of the gas in the scroll chamber 13 becomes minimum, and the ratio R in the above-mentioned condition is maximum, and it is gradually reduced with increase of the rotational speed of the turbine rotor 15.

Thus, at the time of a sudden acceleration the turbine capacity is varied continuously and with satisfactory response in relation not only to the amount of gas generated from the engine but also to the rotational speed of the turbine rotor 15. Thus, it is possible to improve the rising characteristics of the rotation of the turbine rotor 15 and further improve the response of the supercharge pressure.

As has been shown, according to the invention it is possible to attain variable capacity of the turbo supercharger without use of any movable part. It is thus possible to realize a highly reliable variable capacity turbo supercharger at a very low cost compared to the prior art variable capacity turbo supercharger. Further, with the turbo supercharger at the time of the sudden acceleration the turbine capacity is varied continuously with satisfactory response in relation not only to the amount of gas generated from the engine but also to the rotational speed of the turbine rotor. It is thus possible to further enhance the response of the supercharge pressure. Thus, with the variable capacity turbo supercharge according to the invention, unlike the prior art one with a movable part, no control parameter is required for controlling such movable part by detecting the rotational speed of the turbine rotor.

In case where a helical passage is used as fixed swirling generation means, it is possible to manufacture a variable capacity turbo supercharger having high performance substantially at the same cost as the prior art fixed capacity turbo supercharger.

DETAILED DESCRIPTION OF THE INVENTION

Figure 1:
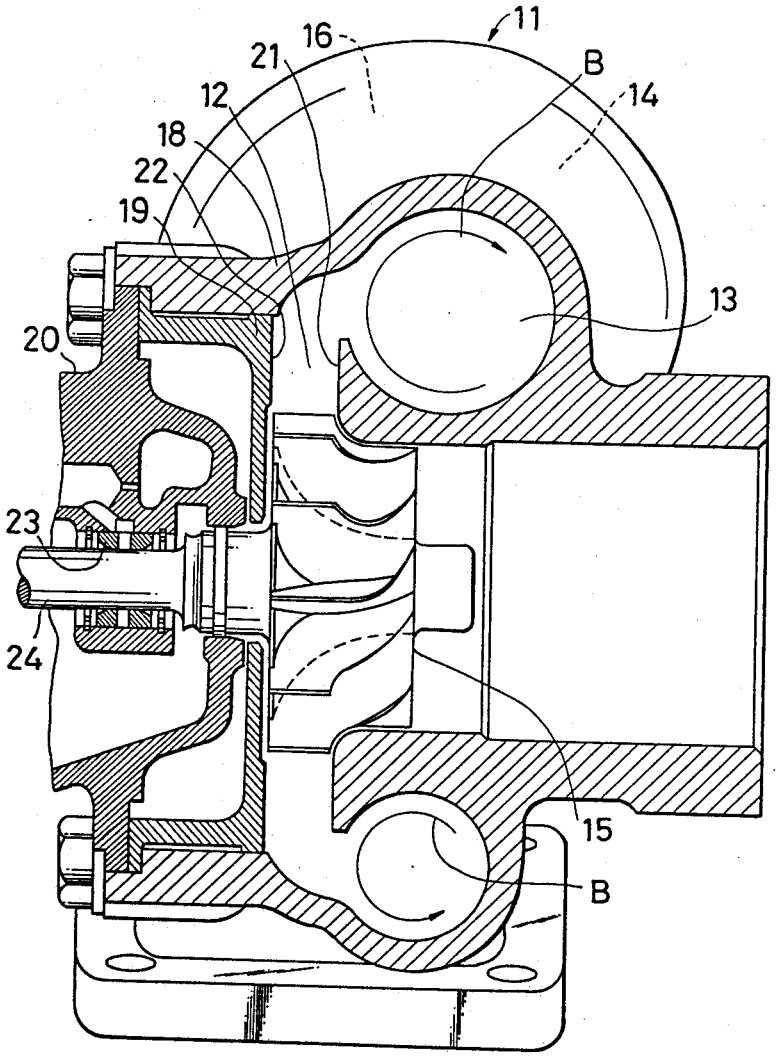
FIG. 1 is a sectional view taken along line A-A in FIG. 2 showing an embodiment of the invention.
Figure 2:
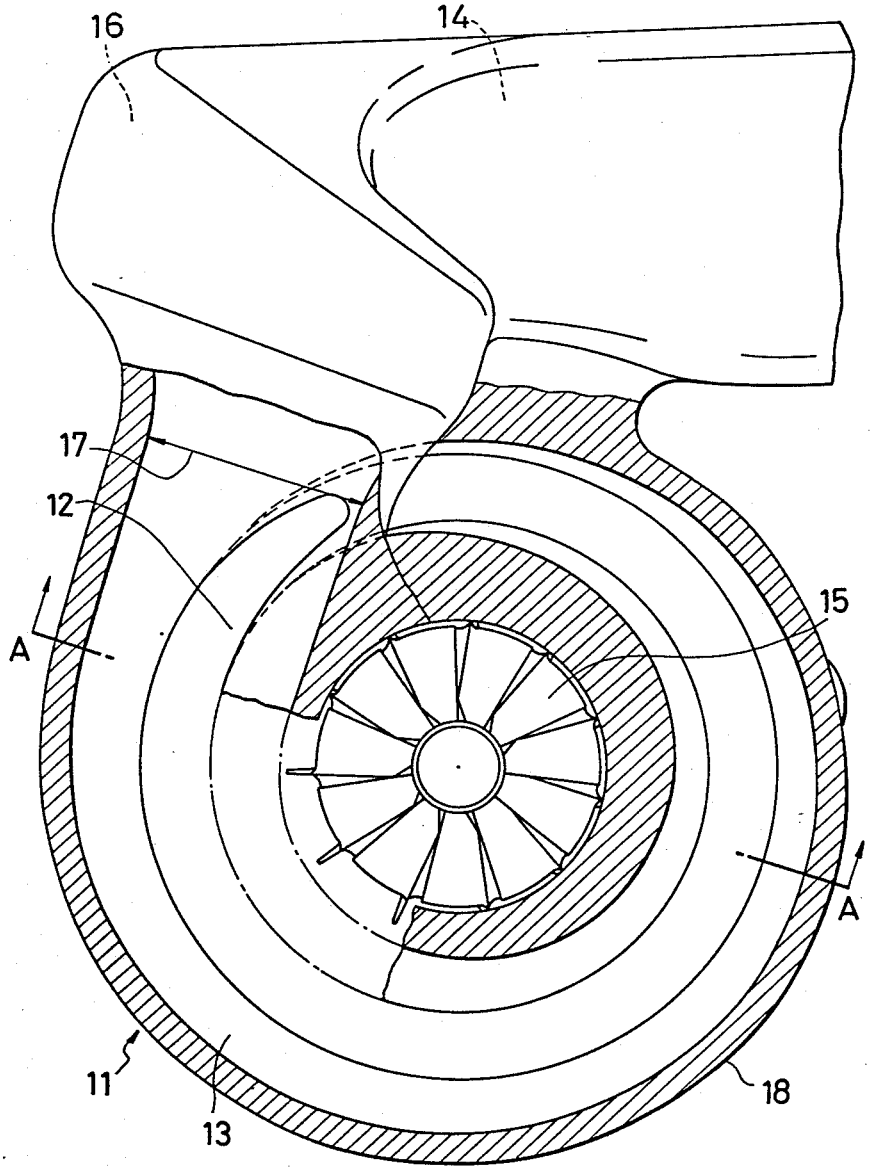
FIG. 2 is a sectional view showing the embodiment shown in FIG. 1.
Figure 3:
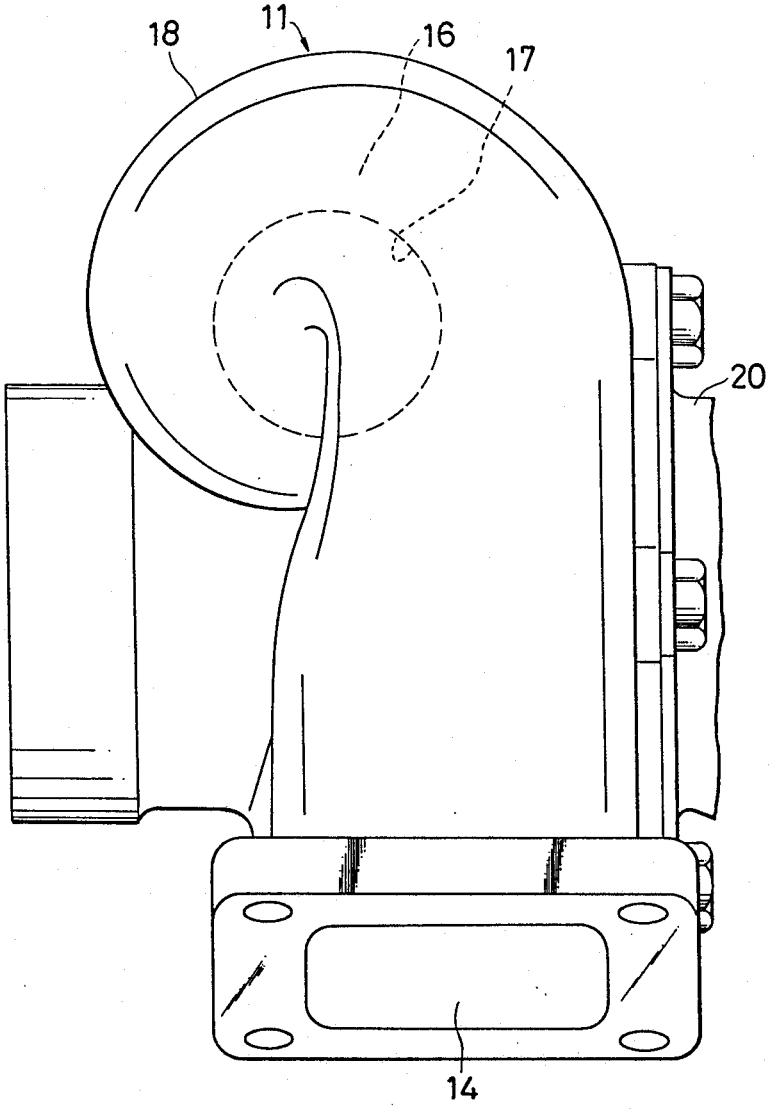
FIG. 3 is a side view showing the embodiment shown in FIG. 1.
Figure 4:
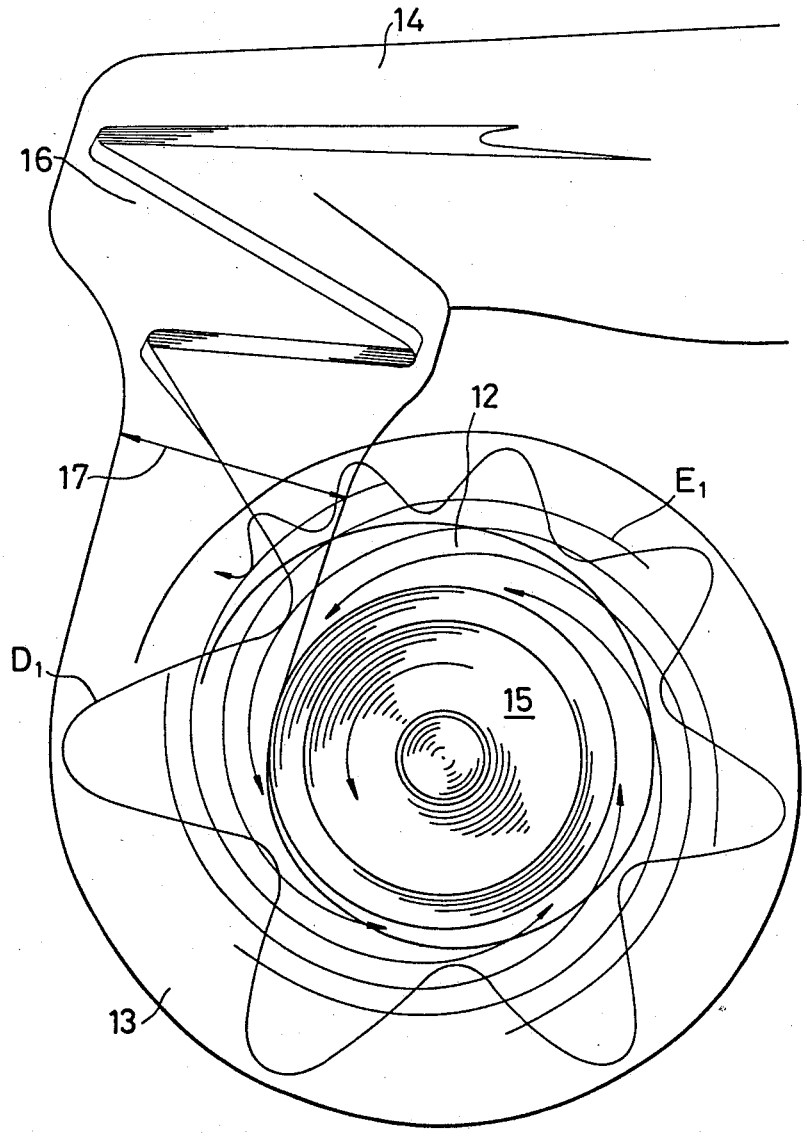
FIG. 4 is a view showing the orbit of swirling and whirling of gas in a low-speed engine-operating condition.
Figure 5:
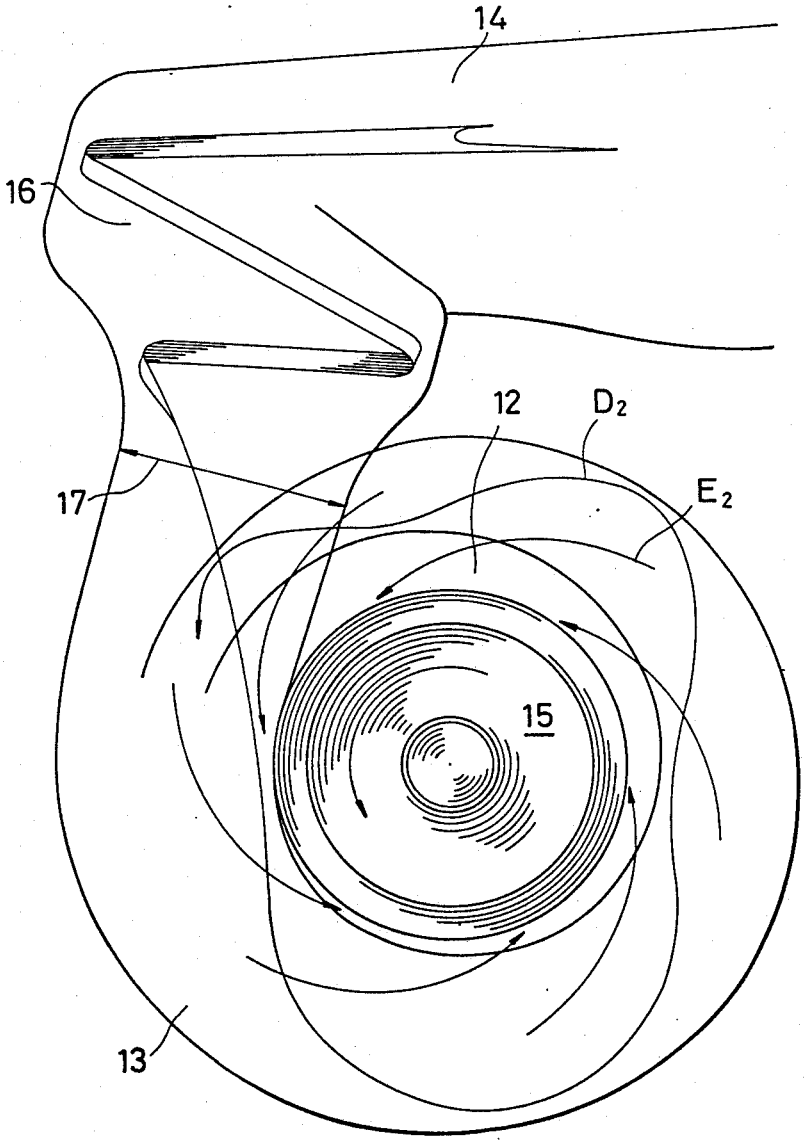
FIG. 5 is a view showing the orbit of swirling and whirling of gas in a high-speed engine-operating condition.
Figure 6:
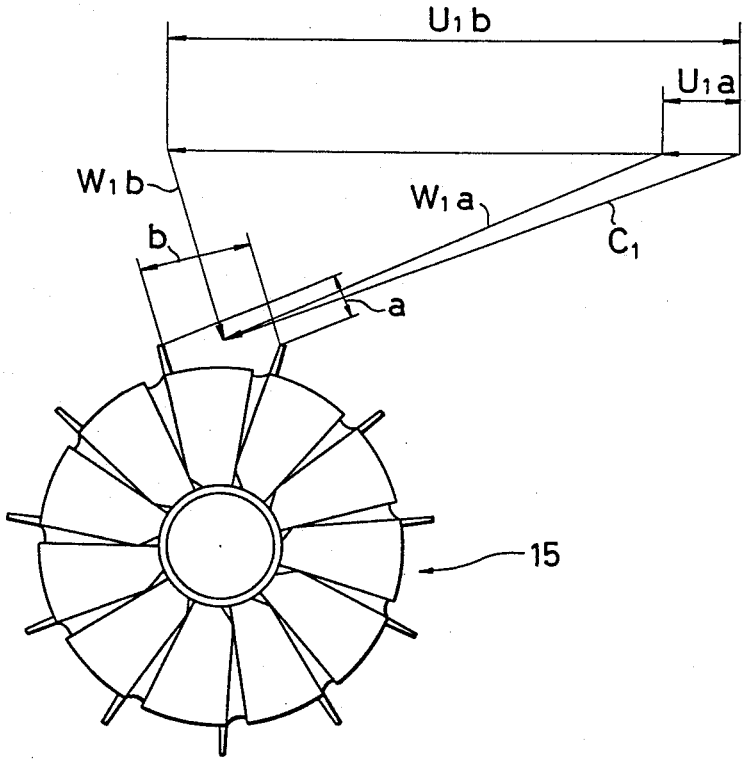
FIG. 6 is a view showing a gas flow velocity triangle.

An embodiment of the invention applied to a turbo supercharger having a general radial turbine to be mounted in a passenger car. FIGS. 1 to 3 shows the embodiment. Referring to the Figures, reference numeral 11 designates a turbine of the turbo supercharger, and numeral 18 designates a turbine housing, in which a turbine rotor 15 is accommodated. The turbine housing 18 is secured via a heat insulation plate 19 to a bearing housing 20. The heat insulation plate 19 and inner wall of the turbine housing 18 constitute side walls 21 and 22 of a nozzle 12. The nozzle 12 is a vaneless nozzle without any static vane. A scroll chamber 13 having a circular sectional profile is provided sidewise of the nozzle 12.

To a shaft 24 integral with the turbine rotor 15 is coaxially secured a compressor rotor (not shown) of a compressor (not shown) for compressing the intake air on the opposite side of the turbine rotor 15. The shaft 24 is rotatably supported via a bearing 23 in a bearing housing 20. Reference numeral 16 designates a helical passage formed as an exhaust gas inlet passage 14. This is the same as the a helical suction port for causing swirling of a fuel-gas mixture in a cylinder in a suction stroke of a reciprocating engine. The helical passage 16 has a winding direction such as to cause swirling in the direction of arrow B in FIG. 1. When the helical passage 16 is adopted as fixed swirling generation means, it is possible to reduce the pressure loss due to the fixed swirling generation means.

Further, the passage 16 can be cast such that it is integral with the turbine housing 18, so that the number of the components can be the same as of the prior art fixed capacity turbo supercharger. It is thus possible to reduce the manufacturing cost to be substantially the same as that of the fixed capacity turbo supercharger. As the fixed swirling generation means fixed guide vanes are also conceivable.

If the scroll chamber 13 in the above embodiment is axially shifted toward the nozzle 12 on the consideration of the capacity of generating swirling of the exhaust gas in the helical passage 16 (i.e., the smaller limit of the swirling pitch, at which swirling of the exhaust gas can be generated in the scroll chamber 13) and variable capacity range, the length of the nozzle 12 can be shortened, and the frictional resistance of the nozzle offered to the exhaust gas can be reduced. The boundary between a radial turbine and oblique flow turbine is not clear, and yet the same end can be attained by tilting the nozzle 12 together with the scroll chamber 13 to obtain a structure closer to an oblique flow turbine. The scroll chamber 13 may have an oval sectional shape to such an extent that the swirling of gas is not disturbed on the greater diameter side.

Further, for causing the gas to enter uniformly over the entire periphery of the turbine rotor 15 in a low-speed engine-operating condition, the modified variation of the sectional area of the flow path of the scroll chamber 13 in the direction of the flow path should be chose. In this case, the gas stream becomes slightly uniform in the nozzle 12 in the high-speed engine operation, but the extent of non-uniformity is ignorable as a whole.

Further, where an exhaust gas bypass valve for controlling the supecharge pressure is provided, the exhaust gas bypass passage may be provided such that it extends from the upstream side of the helical passage 16 of the exhaust gas inlet passage 14.

As has been described in the foregoing, with the general axially dividable scroll type variable capacity turbo supercharger, the scroll chamber half without the on-off valve can not be extremely minimized. Thus, the application of the invention to the scroll chamber half without any on-off valve is available.

While the foregoing description of the embodiment has concerned with a variable capacity turbo supercharger having a radial turbine, the invention is also applicable to oblique flow turbines and axial flow turbines.

What is claimed is:

1. In a variable capacity turbo supercharger having a turbine rotor and a nozzle for the turbine rotor which is a vaneless nozzle, the improvement comprising a scroll chamber having a substantially circular sectional profile flow path, said scroll chamber being disposed sidewise of said nozzle, an exhaust gas inlet passage for introducing exhaust gas into said scroll chamber, a fixed swirling generation means for imparting to the exhaust gas passing through said scroll chamber a screw-like swirling of the exhaust gas whose rotational direction is such that the rotation of said gas moves away from said turbine rotor in the neighborhood of the outlet of said scroll chamber into said nozzle.

2. The variable capacity turbo supercharger according to claim 1, wherein said fixed swirling generation means forms a helical passage.

* * * * *